US008229152B2

(12) United States Patent
Sumitani et al.

(10) Patent No.: US 8,229,152 B2
(45) Date of Patent: Jul. 24, 2012

(54) INTERCHANGEABLE BAR LOUDSPEAKER SYSTEM

(75) Inventors: Yoichiro Sumitani, Rancho Palos Verdes, CA (US); Chun-Yi Lin, Xinzhuang (TW)

(73) Assignee: Sound Sources Technology, Inc.

( * ) Notice: Subject to any disclaimer, the term of this patent is extended or adjusted under 35 U.S.C. 154(b) by 955 days.

(21) Appl. No.: 12/171,942

(22) Filed: Jul. 11, 2008

(65) Prior Publication Data

US 2010/0008522 A1 Jan. 14, 2010

(51) Int. Cl.
*H04R 9/06* (2006.01)
*H04R 1/02* (2006.01)

(52) U.S. Cl. ..... 381/332; 381/334; 381/386; 381/305; 181/199

(58) Field of Classification Search ..... 381/332–336, 381/386, 388, 390, 395, 186, 87, 300–306; 181/199
See application file for complete search history.

(56) References Cited

U.S. PATENT DOCUMENTS 3,976,162 A * 8/1976 Cummings ..... 181/141
5,758,852 A * 6/1998 Martin ..... 248/282.1
5,833,186 A * 11/1998 Kosmoski et al. ..... 248/221.11
5,947,434 A * 9/1999 Kosmoski et al. ..... 248/298.1
6,600,827 B2 * 7/2003 Lu ..... 381/388
6,721,434 B2 * 4/2004 Polk et al. ..... 381/388
2005/0190935 A1 * 9/2005 Sakamoto ..... 381/302
2009/0196450 A1 * 8/2009 Hughes ..... 381/334
2010/0202647 A1 * 8/2010 Kuan ..... 381/334

* cited by examiner

*Primary Examiner* — Ngan Ngo

(74) *Attorney, Agent, or Firm* — Stetina Brunda Garred & Brucker

(57) ABSTRACT

There is provided a speaker connector including first and second speaker elements each having an inward face, an opposing outward face, and an engagement wall extending between the inward and outward faces. The speaker elements are connectable to the first and second speakers, respectively. A connector housing includes first and second end faces disposed on opposing sides of a housing medial portion. First and second inner walls extend inwardly from the first and second end faces, respectively, to define first and second housing recesses. The first and second inner walls are configured to engage with the engagement wall of the respective speaker elements with the first speaker element being received within the first housing recess and the second speaker element being received within the second housing recess.

20 Claims, 3 Drawing Sheets

INTERCHANGEABLE BAR LOUDSPEAKER SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention generally relates to speaker connectors, and more particularly, to a speaker connector for connecting a first speaker to a second speaker.

2. Related Art

Home entertainment systems typically include one or more speakers connected to an audio playback device, such as a receiver, television, compact disk player, etc. The speakers may be used simply to play audio files (e.g., mp3, compact disc, etc.), or to provide audio associated with programming on a television. Consequently, one or more speakers may be positioned near the television to provide optimum audio quality. For instance, a left speaker may be disposed on the left side of the television, while a right speaker may be disposed on the right side of the television.

Older models of televisions and speakers are big and bulky. As a result, the older models of televisions and speakers are commonly placed on the floor. The cumbersome nature of the television and speakers inhibit placing the speakers and/or television in a more aesthetically pleasing position. For instance, the speakers could not easily be hidden from view.

However, recent advances in technology have enabled audio and video equipment to become more compact, and sleeker, while at the same time becoming more powerful. For instance, flat-panel televisions and speakers having smaller physical form factors are available for use with home entertainment systems. Such televisions and speakers are much more compact than their predecessors and are capable of producing images and sounds having a quality that is equal to or greater than their predecessors.

With the advent of smaller, more compact televisions and speakers, it is desirable to place the equipment in more aesthetically pleasing positions. For instance, speakers may be "hidden" in the corners of the room, while flat-panel televisions may be hung on a wall. Although speakers tend to be smaller than their predecessors, it may still be advantageous to place one or more speakers adjacent the television to more easily associate the audio played by the speakers with the video displayed by the television. As such, it may be desirable to align the speakers with television or other furniture. In particular, it may be desirable to place the speakers along one of the edges of the television. Alignment of the speakers with the television may be facilitated by connecting one or more speakers together to alleviate disposal of the speakers adjacent the television or other reference point.

Therefore, it is apparent that there is a need in the art for a device to facilitate connection of a first speaker to a second speaker. The present invention address this particular need, as will be discussed in more detail below.

BRIEF SUMMARY

According to one aspect of the present invention, there is provided a speaker connector for use with a first speaker and a second speaker, each speaker having a speaker housing including an internally threaded housing recess. The speaker connector includes a first speaker element having a first inward face, an opposing first outward face, and a first engagement wall extending between the first inward face and the first outward face along a first speaker element axis. The first speaker element is connectable to the first speaker to dispose the first inward face in a direction facing the first speaker. The speaker connector also includes a second speaker element having a second inward face, an opposing second outward face, and a second engagement wall extending between the second inward face and the second outward face along a second speaker element axis. The second speaker element is connectable to the second speaker to dispose the second inward face in a direction facing the second speaker. The speaker connector further includes a connector housing having a first end face and an opposing second end face. The first and second end faces are disposed on opposing sides of a housing medial portion. A first inner wall extends inwardly from the first end face towards the housing medial portion along a first housing axis to define a first housing recess. The first inner wall is sized and configured to engage with the first engagement wall with the first speaker element being received within the first housing recess to align the first speaker element axis with the first housing axis and to dispose the first inward face of the first speaker element in a direction facing away from the housing medial portion. The connector housing also includes a second inner wall extending inwardly from the second end face towards the housing medial portion along a second housing axis to define a second housing recess. The second inner wall is sized and configured to engage with the second engagement wall with the second speaker element being received within the second housing recess to align the second speaker element axis with the second housing axis and to dispose the second inward face of the second speaker element in a direction facing away from the housing medial portion.

The speaker connector may enable a user to connect a plurality of speakers to each other. For instance, the speakers may be connected to form a "speaker bar." Once the speaker bar is formed, the speakers may be more easily mounted or disposed in an acoustically desirable position, as well as an aesthetically desirable position. For example, it may be desirable to mount the speakers on a wall adjacent a flat panel television. In this manner, the speaker bar may provide audio feedback associated with the programming displayed on the television, while at the same time creating a more aesthetically pleasing appearance as a result of the alignment with the edges of the flat panel television.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. The description sets forth the functions of the invention in connection with the illustrated embodiment. It is to be understood, however, that the same or equivalent functions and may be accomplished by different embodiments that are also intended to be encompassed within the scope of the invention. It is further understood that the use of relational terms such as first and second, top and bottom, and the like are used solely to distinguish one from another entity without necessarily requiring or implying any actual such relationship or order between such entities.

Figure 1:
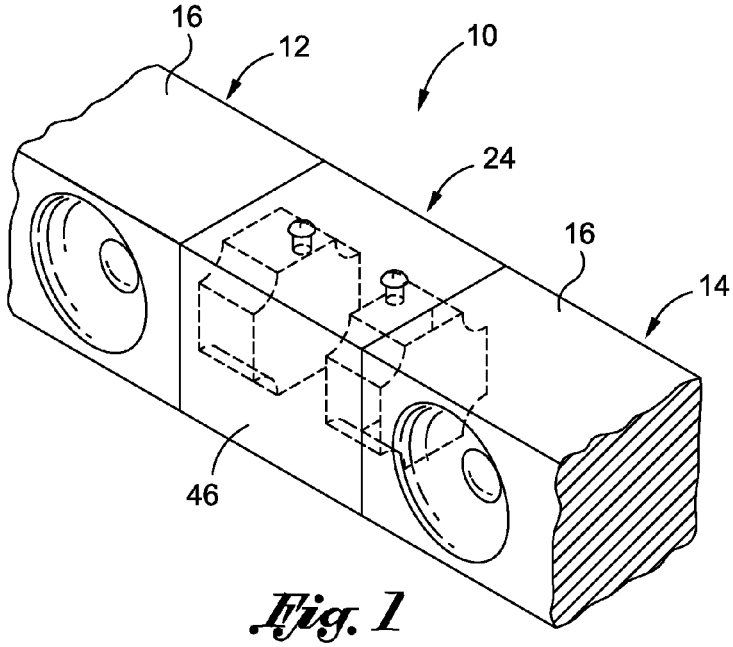
FIG. 1 is a perspective view of a speaker system including a speaker connector for connecting a first speaker to a second speaker.

Referring now specifically to FIG. 1, there is shown a speaker system 10 constructed in accordance with an embodiment of the present invention. The speaker system 10 includes a first speaker 12 and a second speaker 14 with a speaker connector 24 disposed therebetween. According to one embodiment, each of the speakers 12, 14 includes a speaker housing 16 defining a speaker medial face 20 and a speaker lateral face 22. The speaker connector 24 is disposed between the speaker medial faces 20 of the respective first and second speakers 12, 14. Each speaker housing 16 also includes a housing recess 18 formed on a respective speaker medial face 20, as best depicted in FIG. 3.

The first and second speakers 12, 14 may be joined by the speaker connector 24. The connected speakers 12, 14 may form a "speaker bar" to facilitate placement of the speakers 12, 14 in an acoustically desirable configuration as well as an aesthetically pleasing position. The first and second speakers 12, 14 may be left and right speakers connected to an audio playback device. The speaker connector 24 includes a first speaker element 26 that is connectable to the first speaker 12 and a second speaker element 36 that is connectable to the second speaker 14. The first speaker element 26 includes a first inward face 28, an opposing first outward face 30 and a first engagement wall 32 extending between the first inward face 28 and the first outward face 30 along a first speaker element axis 34. Likewise, the second speaker element 36 includes a second inward face 38, an opposing second outward face 40, and a second engagement wall 42 extending between the second inward face 38 and the second outward face 40 along a second speaker element axis 44.

Figure 3:
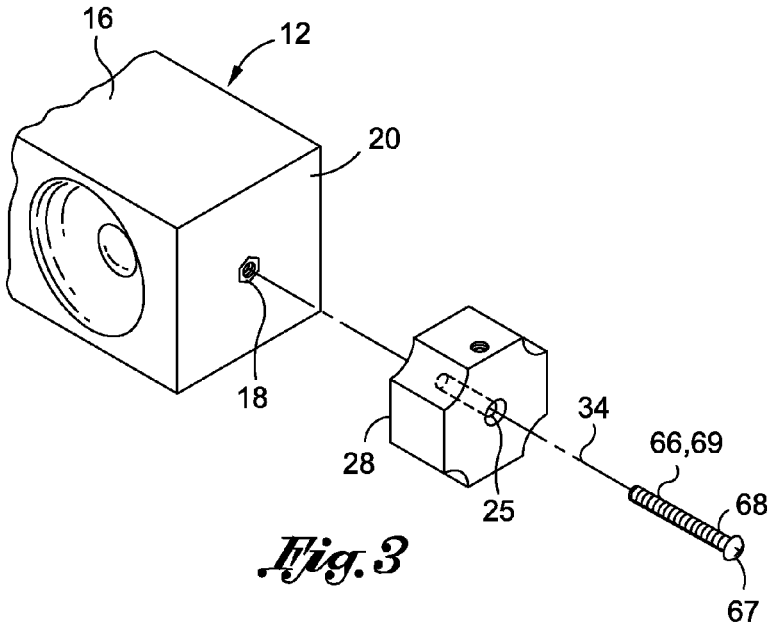
FIG. 3 is an exploded perspective view of the first speaker, the first speaker element and a fastener.

Referring now to FIG. 3, there is shown an exploded perspective view of the first speaker 12, the first speaker element 26, and a fastener 68 for connecting the first speaker element 26 to the first speaker 12. Although FIG. 3 specifically shows the first speaker 12 and the first speaker element 26, it is understood that the second speaker element 36 connects to the second speaker 14 in a similar manner; therefore, the following discussion applies equally to the first speaker 12 and the first speaker element 26, as well as the second speaker 14 and the second speaker element 36. As shown, the first speaker element 26 includes a through-hole 25 extending between the first inward face 28 and the first outward face 30. A fastener 68 is inserted through the through-hole 25 and engages with the first speaker 12.

In one embodiment, the speaker connector 24 includes a threaded post 66 for connecting a respective one of the first and second speaker elements 26, 36 to a respective one of the first and second speakers 12, 14. As shown, the threaded post 66 is included in the fastener 68. The fastener 68 includes a head portion 67 and a shank portion 69. The shank portion 69 is threaded to form the threaded post 66. The threaded post 66 engages with the housing recess 18 formed on the speaker housing 16. In one implementation, the housing recess 18 is internally threaded to facilitate engagement with the threaded post 66. For instance, the housing recess 18 may include an internally threaded nut connected to the speaker housing 16. The fastener 68 is inserted into the through-hole 25 and engages with the internally threaded housing recess 18 to secure the respective speaker element 26, 36 to the respective speaker 12, 14.

The through-hole 25 may include a primary outer diameter at the first outward face 30 that is larger than a secondary outer diameter at the first inward face 28. The fastener 68 may be configured to have a head portion 67 having a diameter that is smaller than the primary outer diameter but larger than the secondary outer diameter to enable the fastener 68 to be recessed within the first speaker element 26 when the fastener 68 is disposed within the through-hole 25.

According to another embodiment, the threaded post 66 is integrally formed with the respective speaker element 26, 36. In this manner, the threaded post 66 may extend from the respective inward face 28, 38 to engage with the respective speaker 12, 14. Furthermore, other fastening means known by those skilled in the art, such as double-sided adhesive tape, may be used to secure the speaker elements 26, 36 to the speakers 12, 14, without departing from the spirit and scope of the present invention.

The first and second speaker elements 26, 36 are configured to engage with a connector housing 46 to facilitate connection of the first and second speakers 12, 14. Referring now to the embodiment shown in FIG. 2, the connector housing 46 includes a first housing end face 48 and an opposing second housing end face 50. A housing medial portion 52 is disposed between the first and second housing end faces 48, 50. A housing length is defined as the distance between the first and second housing end faces 48, 50. The housing length may be varied as desired for particular applications of the speaker connector 24.

The connector housing 46 includes a first inner wall 54 extending inwardly from the first housing end face 48 along a first housing axis 56 to define a first housing recess 58. Likewise, a second inner wall 60 extends inwardly from the second housing end face 50 towards the housing medial portion 52 along a second housing axis 56 to define a second housing recess 64. In the connector housing 46 illustrated in FIG. 2, the first and second housing recesses 58, 64 are coaxially aligned. However, it is understood that the first and second housing axes 56, 62 may not be aligned and may form an angle therebetween. For instance, it may be desirable to connect the speakers 12, 14 in an orthogonal configuration. In that case, the first and second housing axes 56, 62 would be substantially orthogonal relative to each other.

The first inner wall 54 of the connector housing 46 is sized and configured to engage with the first engagement wall 32 of the first speaker element 26. In this manner, the first speaker element 26 is received within the first housing recess 58 to connect the first speaker 12 to the connector housing. In one particular implementation, when the first speaker element 26 is received within the first housing recess 58 to align the first speaker element axis 34 with the first housing axis 56. When the first speaker element 26 is received within the first housing recess 58, the first inward face 28 of the first speaker element 26 is disposed in a direction facing away from the housing medial portion 52.

Similarly, the second inner wall 60 is sized and configured to engage with the second engagement wall 42 of the second speaker element 36 to receive the second speaker element 36 within the second housing recess 64. When the second speaker element 36 is received within the second housing recess 64, the second housing axis 62 is aligned with the second speaker element axis 44. Furthermore, the second inward face 38 of the second speaker element is disposed in a direction facing away from the housing medial portion 52 when the second speaker element 36 is received within the second housing recess 64.

Figure 2:
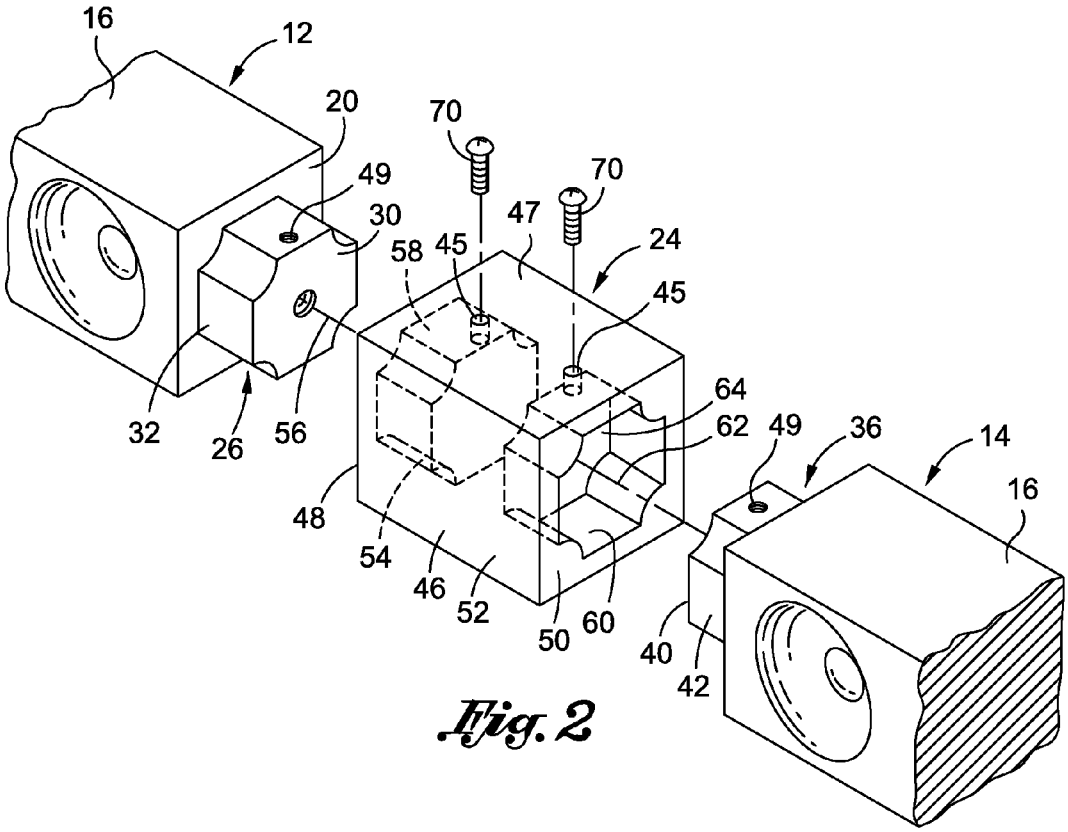
FIG. 2 is a an exploded perspective view of the speaker system illustrated in FIG. 1, the speaker connector including a first speaker element, a second speaker element and a connector housing.

In the embodiments shown in FIGS. 1 and 2, the first and second housing recesses 58, 64 each extend partially into the connector housing 46. In this manner, the first housing recess 58 does not extend and connect with the second housing recess 64. However, it is contemplated that various implementations of the present invention may include a connector housing 46 having a first housing recess 58 that extends and connects with the second housing recess 64. In this manner, the first inner wall 54 may extend and connect with the second inner wall 60. In this manner, an opening may be formed to extend between the first housing end face 48 and the second housing end face 50.

It is contemplated that the first housing recess 58 may be configured to engage specifically with the first speaker element 26. Likewise, the second housing recess 64 may be configured to engage specifically with the second speaker element 36. In this manner, the first and second speaker elements 26, 36 may be sized and configured to have different dimensions that correspond with the first and second housing recesses 58, 64, respectively. It may be desirable to configure the first and second speaker elements 26, 36 to have different dimensions to ensure specific speaker configurations. For instance, the first speaker element 26 may be connected to a left speaker while the second speaker element 36 may be connected to a right speaker. Therefore, the left and right speakers may be disposed on specific sides or the connector housing 46. However, it is also contemplated that the first and second speaker elements 26, 36 may have substantially identical sizes and configurations and may be received within either one of the first and second housing recesses 58, 64.

Figure 4:
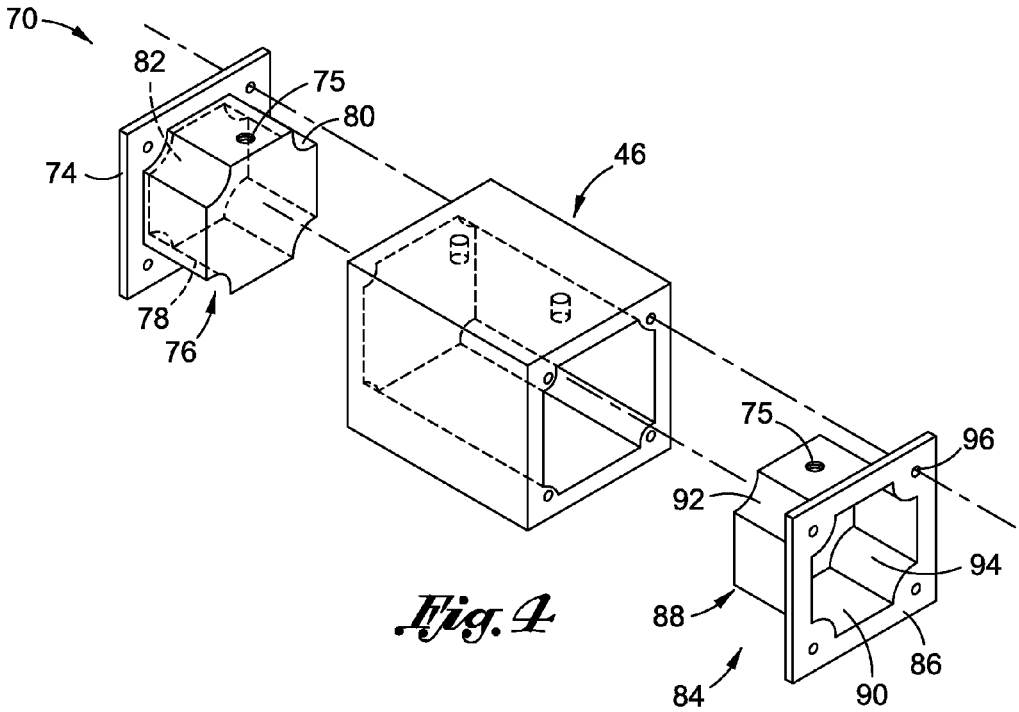
FIG. 4 is a perspective view of another embodiment of a connector housing being engageable with a first intermediate member and a second intermediate member.

Referring now to FIG. 4, various aspects of the present invention include first and second intermediate members 72, 84 that are disposable between the connector housing 46 and the respective first and second speaker elements 26, 36. In this regard, the first and second intermediate members 72, 84 are configured to engage with connector housing 46, and the first and second speaker elements 26, 36 are configured to engage with the first and second intermediate elements 72, 84, respectively.

The first intermediate member 72 includes a first intermediate end portion 74 and a first intermediate engagement portion 76 including a first intermediate inner wall 78 extending from the first intermediate end portion 74 to define a first intermediate recess 82. The first intermediate engagement portion 76 also includes a first intermediate outer wall 80. The first intermediate inner wall 78 is sized and configured to engage with the first engagement wall 32 of the first speaker element 26. In this manner, the first intermediate recess 82 is sized and configured to receive the first speaker element 26. The first speaker element 26 may be received within the first intermediate recess 82 to dispose the first outward face 30 in a direction facing away from the first intermediate recess 82.

Similarly, the second intermediate member 84 includes a second intermediate end portion 86 and a second intermediate engagement portion 88 having a second intermediate inner wall 90 extending from the second intermediate end portion 86 to define a second intermediate recess 94. The second intermediate inner wall 90 is sized and configured to engage with the second engagement wall 42 of the second speaker element 36. Consequently, the second intermediate recess 94 is sized and configured to receive the second speaker element 36. The second speaker element 36 may be received within the second intermediate recess 94 to dispose the second outward face 40 in a direction facing away from the second intermediate recess 94.

The first intermediate member 72 may be sized and configured to specifically engage with the first speaker element 26, while the second intermediate member 84 may be configured to specifically engage with the second speaker element 36. Conversely, the first and second intermediate members 72, 84 may be engage with either one of the first and second speaker elements 26, 36.

The first and second intermediate members 72, 84 are engagable with the connector housing 46. In particular, the first inner wall 54 of the connector housing 46 may be sized and configured to engage with the first intermediate engagement portion 76 of the first intermediate member 72. In this manner, the first intermediate outer wall 80 may be disposable in contact with the first inner wall 54 to dispose the first intermediate engagement portion 76 within the first housing recess 58. Likewise, the second inner wall 60 of the connector housing 46 may be sized and configured to engage with the second intermediate engagement portion 88 with the second intermediate member 84 being received within the second intermediate recess 94.

The first and second intermediate members 72, 84 may include one or more apertures 96 formed within the respective intermediate end portions 74, 86 to facilitate connection between the respective intermediate member 72, 84 and the connector housing 46. For example, nails, screws, rivets, or other fastening elements known by those skilled in the art may be used to connect the intermediate members 72, 84 to the connector housing 46.

According to various aspects of the present invention, the speaker connector 24 may include a securing member 70 configured to secure the first and second speaker elements 26, 36 to the connector housing 46. As best shown in FIG. 2, the connector housing 46 may include one or more securing openings 45 extending from a securing surface 47 and the housing recesses 58, 64. Furthermore, each speaker element 26, 36 includes a speaker element securing opening 49 that is aligned with the securing opening 45 when the respective speaker element 26, 36 is received within the respective one of the housing recesses 58, 64. The speaker element securing opening 49 may be internally threaded, and the securing member 70 may be threaded to facilitate engagement between the securing member 70 and the speaker elements 26, 36.

In embodiments having first and second intermediate members 72, 84, each intermediate member 72, 84 may include an intermediate securing opening 75 through which the securing member 70 extends to securely connect the speaker elements 26, 36 to the respective intermediate members 72, 84 within the connector housing 46.

Figure 5:
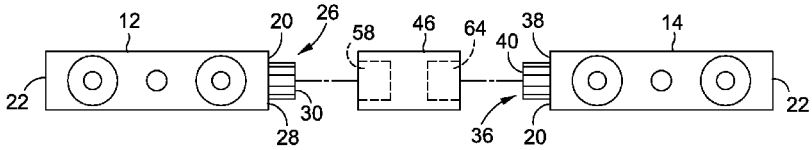
FIG. 5 is an elevation view of a speaker system having first and second speakers being connectable by a speaker connector.
Figure 6:
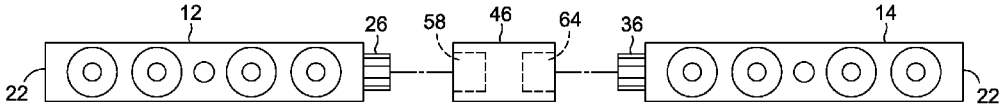
FIG. 6 is an elevation view of a speaker system having first and second speakers being connectable by a speaker connector.
Figure 7:
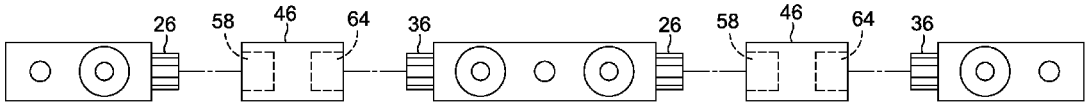
FIG. 7 is an elevation view of a speaker system having three speakers being connectable by two speaker connectors.

Referring now to FIGS. 5-7, there is shown several exemplary speaker systems 10. With regard to the speaker systems 10 shown in FIGS. 5 and 6, each speaker system 10 includes two speakers disposed on opposing sides of the speaker connector 24. Each speaker 12, 14 includes a speaker medial face 20 having a respective speaker element 26, 36 connected thereto. Furthermore, each speaker 12, 14 also includes a speaker lateral face 22. The first and second speakers 12, 14 are connected by the speaker connector 24. The main distinction between the speaker system 10 illustrated in FIG. 5 and the speaker system 10 illustrated in FIG. 6 is that the first and second speakers 12, 14 in the speaker system 10 illustrated in FIG. 6 are longer than the first and second speakers 12, 14 included in the speaker system 10 shown in FIG. 5.

Referring now specifically to the embodiment shown in FIG. 7, there is shown a speaker system 10 having three speakers and two speaker connectors 24. In this manner, various aspects of the present invention may include speaker systems 10 having N speakers and N−1 speaker connectors 24. The outermost speakers in the speaker system 10 illustrated in FIG. 7 each include a speaker medial face 20 and a speaker lateral face 22 similar to the speakers discussed above in relation to FIG. 5 and FIG. 6. In this regard, the outermost speakers have a speaker element 26, 28 connected to the speaker medial face 20. However, the speaker system 10 illustrated in FIG. 7 also includes an inner speaker having two speaker elements 26, 28 connected to opposing end faces thereof. Each speaker element 26, 28 is engageable with a connector housing 46 to connect the plurality of speakers.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A speaker connector for use with a first speaker and a second speaker, each speaker having a speaker housing including an internally threaded housing recess, the speaker connector comprising:

a first speaker element having a first inward face, an opposing first outward face, and a first engagement wall extending between the first inward face and the first outward face along a first speaker element axis, the first speaker element being connectable to the first speaker to dispose the first inward face in a direction facing the first speaker;

a second speaker element having a second inward face, an opposing second outward face, and a second engagement wall extending between the second inward face and the second outward face along a second speaker element axis, the second speaker element being connectable to the second speaker to dispose the second inward face in a direction facing the second speaker; and a connector housing having:

a first housing end face and an opposing second housing end face, the first and second housing end faces being disposed on opposing sides of a housing medial portion;

a first inner wall extending inwardly from the first housing end face towards the housing medial portion along a first housing axis to define a first housing recess, the first inner wall being sized and configured to engage with the first engagement wall with the first speaker element being received within the first housing recess to align the first speaker element axis with the first housing axis and to dispose the first inward face of the first speaker element in a direction facing away from the housing medial portion; and a second inner wall extending inwardly from the second housing end face towards the housing medial portion along a second housing axis to define a second housing recess, the second inner wall being sized and configured to engage with the second engagement wall with the second speaker element being received within the second housing recess to align the second speaker element axis with the second housing axis and to dispose the second inward face of the second speaker element in a direction facing away from the housing medial portion.

2. The speaker connector of claim 1 further comprising a pair of threaded posts, each threaded post being configured to connect a respective one of the first and second speaker elements to a respective one of the first and second speakers.

3. The speaker connector of claim 2 further including a pair of fasteners, each fastener including a respective one of the pair of threaded posts.

4. The speaker connector of claim 1 further including a pair of fasteners, each fastener being configured to connect a respective one of the first and second speaker elements to a respective one of the first and second speakers.

5. The speaker connector of claim 1 wherein the connector housing defines a securing surface and a housing securing opening extending between the securing surface and at least one of the first and second housing recesses.

6. The speaker connector of claim 5 wherein at least one of the first and second speaker elements includes a speaker element securing opening aligned with the housing securing opening when the at least one of the first and second speaker elements is received within the respective one of the first and second housing recesses.

7. The speaker connector of claim 6 further comprising a securing member being disposable within the housing securing opening and the speaker element securing opening to connect the connector housing with the respective one of the first and second speaker elements.

8. A speaker system comprising:

a first speaker and a second speaker; and a speaker connector comprising:

a first speaker element having a first inward face, an opposing first outward face, and a first engagement wall extending between the first inward face and the first outward face along a first speaker element axis, the first speaker element being connectable to the first speaker to dispose the first inward face in a direction facing the first speaker;

a second speaker element having a second inward face, an opposing second outward face, and a second engagement wall extending between the second inward face and the second outward face along a second speaker element axis, the second speaker element being connectable to the second speaker to dispose the second inward face in a direction facing the second speaker; and a connector housing having:

a first housing end face and an opposing second housing end face, the first and second housing end faces being disposed on opposing sides of a housing medial portion;

a first inner wall extending inwardly from the first housing end face towards the housing medial portion along a first housing axis to define a first housing recess, the first inner wall being sized and configured to engage with the first engagement wall with the first speaker element being received within the first recess to align the first speaker element axis with the first housing axis and to dispose the first inward face of the first speaker element in a direction facing away from the housing medial portion; and a second inner wall extending inwardly from the second housing end face towards the housing medial portion along a second housing axis to define a second housing recess, the second inner wall being sized and configured to engage with the second engagement wall with the second speaker element being received within the second housing recess to align the second speaker element axis with the second housing axis and to dispose the second inward face of the second speaker element in a direction facing away from the housing medial portion.

9. The speaker system of claim 8 wherein each speaker includes a speaker housing having an internally threaded housing recess.

10. The speaker system of claim 9 further comprising a pair of threaded posts, each threaded post being configured to connect a respective one of the first and second speaker elements to a respective one of the first and second speakers.

11. The speaker system of claim 10 further including a pair of fasteners, each fastener including a respective one of the pair of threaded posts.

12. The speaker system of claim 8 further including a pair of fasteners, each fastener being configured to connect a respective one of the first and second speaker elements to a respective one of the first and second speakers.

13. A speaker connector for use with a first speaker and a second speaker, each speaker having a speaker housing including an internally threaded housing recess, the speaker connector comprising:

a first speaker element having a first inward face, an opposing first outward face, and a first engagement wall extending between the first inward face and the first outward face along a first speaker element axis, the first speaker element being connectable to the first speaker to dispose the first inward face in a direction facing the first speaker;

a second speaker element having a second inward face, an opposing second outward face, and a second engagement wall extending between the second inward face and the second outward face along a second speaker element axis, the second speaker element being connectable to the second speaker to dispose the second inward face in a direction facing the second speaker;

a first intermediate member having a first intermediate end portion and a first intermediate engagement portion, the first intermediate engagement portion having a first intermediate inner wall extending from the first intermediate end portion to define a first intermediate recess, the first intermediate inner wall being sized and configured to engage with the first engagement wall with the first speaker element being received within the first intermediate recess;

a second intermediate member having a second intermediate end portion and a second intermediate engagement portion, the second intermediate engagement portion having a second intermediate inner wall extending from the second intermediate end portion to define a second intermediate recess; the second intermediate inner wall being sized and configured to engage with the second engagement wall with the second speaker element being received within the second intermediate recess; and a connector housing having:

a first housing end face and an opposing second housing end face, the first and second housing end faces being disposed on opposing sides of a housing medial portion;

a first inner wall extending inwardly from the first housing end face towards the housing medial portion along a first housing axis to define a first housing recess, the first inner wall being sized and configured to engage with the first intermediate engagement portion with the first intermediate member being received within the first housing recess; and a second inner wall extending inwardly from the second housing end face towards the housing medial portion along a second housing axis to define a second housing recess, the second inner wall being sized and configured to engage with the second intermediate engagement portion with the second intermediate member being received within the second intermediate recess.

14. The speaker connector of claim 13 further comprising a pair of threaded posts, each threaded post being configured to connect a respective one of the first and second speaker elements to a respective one of the first and second speakers.

15. The speaker connector of claim 14 further including a pair of fasteners, each fastener including a respective one of the pair of threaded posts.

16. The speaker connector of claim 13 further including a pair of fasteners, each fastener being configured to connect a respective one of the first and second speaker elements to a respective one of the first and second speakers.

17. The speaker connector of claim 13 wherein the connector housing defines a securing surface and a housing securing opening extending between the securing surface and at least one of the first and second housing recesses.

18. The speaker connector of claim 17 wherein at least one of the first and second intermediate members includes an intermediate securing opening aligned with the housing securing opening when the at least one of the first and second intermediate members is received within the respective one of the first and second housing recesses.

19. The speaker connector of claim 18 wherein at least one of the first and second speaker elements includes a speaker element securing opening aligned with the intermediate securing opening when the at least one of the first and second speaker elements is received within the respective one of the first and second intermediated recesses.

20. The speaker connector of claim 19 further comprising a securing member being disposable within the housing securing opening, the intermediate securing opening and the speaker element securing opening to connect the connector housing with the respective one of the first and second intermediate members and the respective one of the first and second speaker elements.

* * * * *